US007040868B2

(12) United States Patent
McLaughlin et al.

(10) Patent No.: US 7,040,868 B2
(45) Date of Patent: May 9, 2006

(54) PUMPING SYSTEM FOR CONTROLLING PUMPING SPEED DURING DISCHARGE PRESSURE FLUCTUATIONS

(76) Inventors: John E. McLaughlin, 3 Country La., Lake Grove, NY (US) 11755; Neocles G. Athanasiades, 6 Mayeeck Dr., Setauket, NY (US) 11723; Toh M. Meng, 15 Sunflower Dr., Hauppauge, NY (US) 11788

( * ) Notice: Subject to any disclaimer, the term of this patent is extended or adjusted under 35 U.S.C. 154(b) by 385 days.

(21) Appl. No.: 10/647,182

(22) Filed: Aug. 25, 2003

(65) Prior Publication Data

US 2005/0047921 A1 Mar. 3, 2005

(51) Int. Cl.
*F04B 49/00* (2006.01)

(52) U.S. Cl. ..... 417/34; 417/43

(58) Field of Classification Search ..... 417/34, 417/43, 364, 63; 415/17, 26, 116
See application file for complete search history.

(56) References Cited

U.S. PATENT DOCUMENTS

| | | | | |
|---|---|---|---|---|
| 3,786,869 | A * | 1/1974 | McLoughlin | 169/24 |
| 3,974,879 | A * | 8/1976 | Nelson et al. | 169/43 |
| 3,981,618 | A * | 9/1976 | Nelson, Jr. | 417/12 |
| 4,128,476 | A * | 12/1978 | Rock | 210/659 |
| 5,888,051 | A * | 3/1999 | McLoughlin et al. | 417/53 |

* cited by examiner

*Primary Examiner*—Charles Freay
*Assistant Examiner*—Vikansha Dwivedi
(74) *Attorney, Agent, or Firm*—Frank L. Hart

(57) ABSTRACT

The pressure downstream of a pump is measured and the speeds of the engine and pump are controlled in response to pressure changes downstream of the pump by a controlling element overriding a governor of the engine. The speed of the engine and the pump are connected to and controlled by an engine governor.

6 Claims, 1 Drawing Sheet

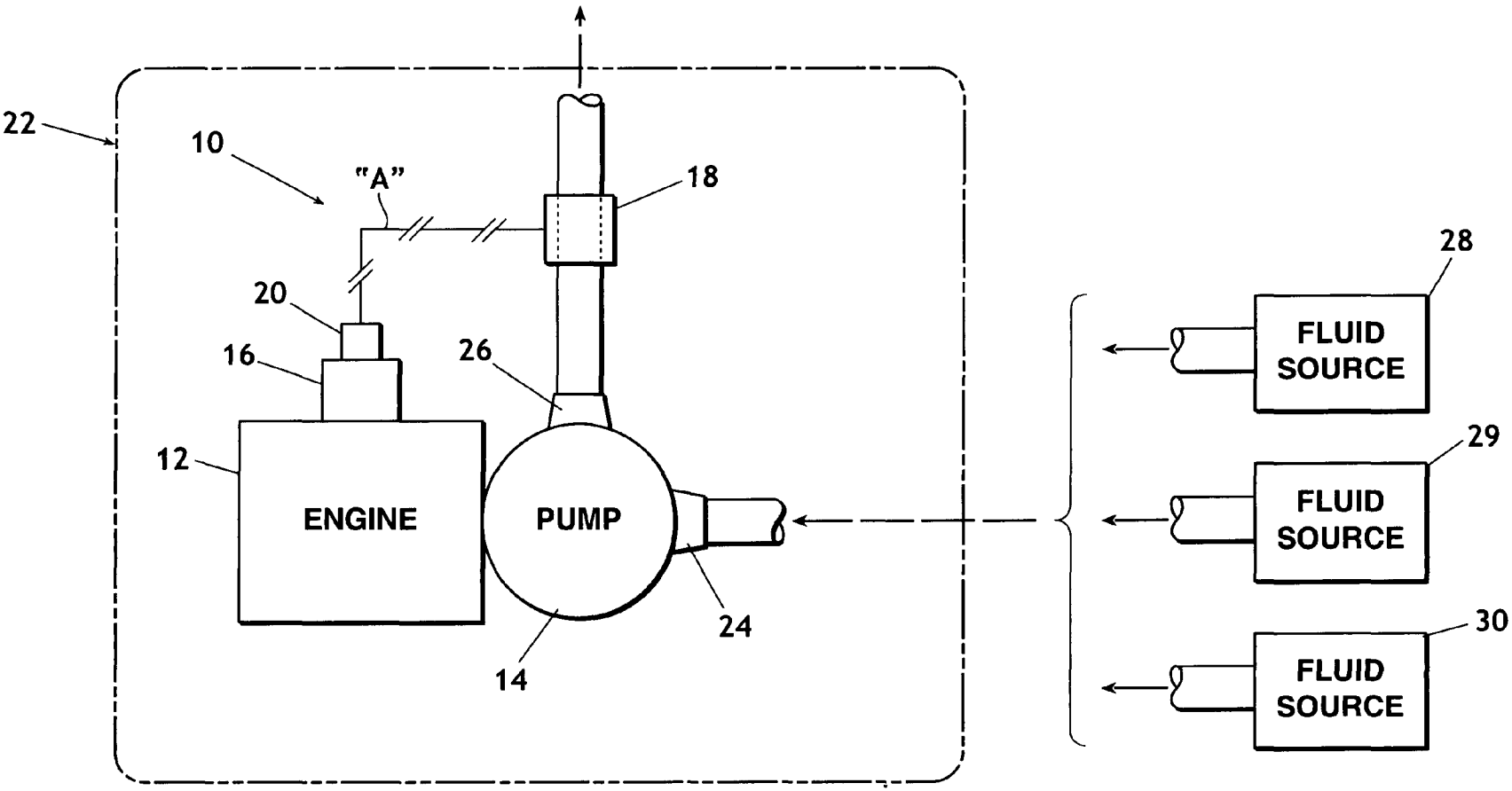
28
29
30
FLUID SOURCE
FLUID SOURCE
FLUID SOURCE
18
24
PUMP
14
26
"A"
ENGINE
20
16
10
12
22

PUMPING SYSTEM FOR CONTROLLING PUMPING SPEED DURING DISCHARGE PRESSURE FLUCTUATIONS

TECHNICAL FIELD

The subject invention relates to apparatus for controlling the speed of a fluid pump.

More particularly, the subject invention relates to apparatus for controlling the speed of a fluid pump during discharge pressure fluctuations caused by the type of fluid being pumped.

BACKGROUND ART

In the pumping of liquid, there are sometimes situations in which a volume of air is drawn into the intake of the pump. One example, without limitations, is found in fire trucks which pump liquid from various sources, such as for example, a lake, a tanker truck, a hydrant and a tank. Such air volume or slug is often introduced into the pump after uncoupling the pump inlet from one fluid source and connecting said inlet to a different fluid source. Another introduction of an air slug into the pumping system sometimes results from the suction of the pump being undesirably near the surface of liquid where a vortex might form and draw air into the pump with the liquid.

Irrespective of how the volume of air or gasses enter the system, their occurrence during pumping operation causes an undesirable pressure drop down stream of the pump and a corresponding increase in engine speed and pumping speed owing to the reduced engine load. Once the slug of gas has passed the pump, liquid will enter the pump which is then operating in an over-speed condition. This will cause an undesirable and sometimes dangerous pressure surge downstream of the pump and will also function to shorten the life of the pump and engine.

A situation for which this pumping system is particularly adapted and useful is on a fire truck wherein detrimental discharge pressure surges sometimes causes firemen to be unable to control the discharge hose which will whip around and injure or kill.

The present invention is directed to overcome one or more of the heretofore problems, as set forth above.

DISCLOSURE OF THE INVENTION

In one aspect of the invention, a system is provided for pumping fluid which system includes an engine connected to and operating a pump having an outlet and an inlet and being connectable to a fluid source. The speed of the engine and the pump are connected to and controlled by an engine governor. The pump is adapted to pump liquid and intermittently pump gasses. A pressure transducer is connected to the governor of the engine and the outlet of the pump and is adapted to measure the fluid discharge pressure downstream of the pump and deliver a signal "A" responsive to said measured pump discharge pressure. The governor is connected to the engine and adapted for controlling the operating speed of the engine and thereby the speed of the pump in response to changes in the magnitude of received signal "A". A controlling element is connected to the governor and the pressure transducer and is adapted to receive signal "A" and override the governor and control the operation of the engine and the pump in response to pump discharge pressure fluctuations of a preselected magnitude within a preselected period of time.

BRIEF DESCRIPTION OF THE DRAWINGS

FIG. 1 is a diagrammatic frontal view of the apparatus of this invention.

BEST MODE FOR CARRYING OUT THE INVENTION

Referring to FIG. 1, the pumping system 10 of this invention has an engine 12, a pump 14, a governor 16, a transducer 18, and a controlling element 20. The pumping system 10 is particularly useful in a fire truck 22 for pumping liquid and intermittently pumping gasses or air. It should be understood, however, that the system 10 can be used in any application where the medium being pumped varies between liquid and gas and that such use will function to extend the operating life of the pump and engine by the avoidance of hydraulic shock.

The pump 14 has an inlet 24 and an outlet 26. The pump 14 is preferably a centrifugal pump and is connected to and operated by the engine 12. The inlet 24 of the pump 14 is connectable to a plurality of different fluid sources 28, 29, 30, for example. Without limitation, examples of these fluid sources 28–30 are a tanker truck, a lake, and a fire hydrant.

The governor 16 is connected to the engine 12 and adapted for controlling the speed of the engine 12 and thereby the speed of the pump 14. The transducer 18 is associated with the fluid discharging from the pump outlet 26 and is adapted to measure the pressure of the fluid and deliver a signal "A" responsive to the magnitude of said measured pressure.

A controlling element 20 is connected to the governor 16 and to the transducer 18. The controlling element 20 is adapted to receive signal "A", compare signal "A" to a set-point signal, override the governor 16 and control the speeds of the engine 12 and the pump 14 in response to the measured pressure downstream of the pump 14 fluctuating in magnitude over a preselected period of time of less than 1 second.

Shorter time periods less then about 1 second are undesirable because it would cause the system to be too sensitive, alter operations too frequently and unnecessarily wear out the equipment. A longer time period than 1 second is undesirable because it would allow undesirable hydraulic shock to be placed on the equipment which would unnecessarily wear the equipment. By the same token, pressure fluctuation ranges less than 25 percent would not necessarily be an indication of a damaging slug of air or gas.

In response to the measured discharge pressure decreasing in the range of about 25 to about 100 percent in a period of about less than 1 second in response to the fluid passing through the pump 14 changing from a liquid to one of a gas or a gaseous liquid, the controlling element 20 will override the governor 16 and selectively maintain the pump speed constant or decrease said pump speed.

INDUSTRIAL APPLICABILITY

The operation of this invention will, for convenience, be described with relation to the operation of a fire truck. In this example use, the fire truck arrives at the scene of a fire and begins pumping water on the fire from its internal water tank while firemen string a hose from the fire truck to a fire hydrant. Once connected to the fire hydrant, valves (not shown) are switched and the suction of the pump is then closed to the fire truck water tank and open to the fire hydrant.

Since the hose from the pump to the fire hydrant is empty, a slug of air will pass through the pump before water from the hydrant arrives at the pump via the hose. As this slug of air enters the pump, the load on the engine is drastically reduced and the engine will attempt to increase to an over-speed condition. However, with the pumping system of this invention, the over-speed condition will be prevented by the controlling element overriding the governor of the engine.

This system therefore prevents hydraulic shocks from being subjected upon the pump, the engine, and the discharge nozzle which will be held by a fireman. This invention therefore will not only extend the operating life of the engine and pump, but will also provide a safer pumping system for the firemen to operate.

Other aspects, objects and advantages of this invention can be obtained from a study of the drawings, the disclosure and the appended claims.

What is claimed is:

1. In a system for pumping fluid including an engine, an engine governor, and a pump, said engine being connected to and operating the pump having an outlet and an inlet and said system being connectable to a fluid source and wherein said pump is adapted to pump liquid and intermittently pump gasses, the improvement comprising:

a pressure transducer connected to the governor of the engine and the outlet of the pump and being adapted to measure the fluid discharge pressure downstream of the pump and deliver a signal (A) responsive to said measured discharge pressure;

said governor being connected to the engine and adapted for controlling the operating speed of the engine and thereby the speed of the pump in response to changes in the magnitude of received signal (A); and a controlling element connected to the governor and the pressure transducer and being adapted to receive signal (A) and override the governor and control the operation of the engine and the pump in response to pump discharge pressure fluctuation within a preselected period of time of less than 1 second.

2. A fluid pumping system, as set forth in claim 1, wherein the controlling element overrides the governor and selectively maintains the pump speed constant or decreases said pump speed in response to the measured discharge pressure decreasing in the range of about 25 to about 100 percent in less than about 1 second in response to the fluid passing through the pump changing from a liquid to one of a gas or a gaseous liquid.

3. A fluid pumping system, as set forth in claim 1, wherein the fluid pumping system is adapted for the pumping of water and intermittently pumping volumes of air.

4. A fluid pumping system, as set forth in claim 1, wherein the fluid pumping system is associated with a fire truck.

5. A fluid pumping system, as set forth in claim 1, wherein pump of the fluid pumping system is adapted to receive liquid from a plurality of different liquid sources.

6. A fluid pumping system, as set forth in claim 1, wherein the pump is a centrifugal pump.

* * * * *